343-754 SR
6/1/82 OR 4,333,082

United States Patent [19]
Susman

[11] 4,333,082
[45] Jun. 1, 1982

[54] INHOMOGENEOUS DIELECTRIC DOME ANTENNA

[75] Inventor: Leon Susman, Sudbury, Mass.

[73] Assignee: Sperry Corporation, New York, N.Y.

[21] Appl. No.: 135,427

[22] Filed: Mar. 31, 1980

[51] Int. Cl.[3] ..... H01Q 15/08
[52] U.S. Cl. ..... 343/754; 343/854; 343/911 R
[58] Field of Search ..... 343/753, 754, 755, 854, 343/909, 911 R, 911 L

[56] References Cited

U.S. PATENT DOCUMENTS 2,761,141 8/1956 Strandberg et al. ..... 343/911 L
3,384,890 5/1968 List et al. ..... 343/754
3,755,815 8/1973 Stangel et al. ..... 343/911
3,848,255 11/1974 Migdal ..... 343/911 L
4,254,421 3/1981 Kreutel ..... 343/754

*Primary Examiner*—Eli Lieberman
*Attorney, Agent, or Firm*—Howard P. Terry; Seymour Levine

[57] ABSTRACT

A dome antenna including a dome of solid dielectric material and scannable feed array positioned in the base plane thereof. The dielectric material of the dome constructed to provide a dielectric constant that varies with the perpendicular distance from the base plane. Rays emanating from the base plane are continuously refracted within the dome and refracted at the surface thereof, the interface with free space, to accomplish sufficient a scan angle amplification for scanning beam to the horizon and below.

3 Claims, 6 Drawing Figures

INHOMOGENEOUS DIELECTRIC DOME ANTENNA

BACKGROUND OF THE INVENTION

1. Field of the Invention

The subject invention pertains to the art of antennas and particularly to a combination of elements which includes a phase array antenna enclosed within a dielectric lens, the combination of which is an antenna capable of providing scanned beams with hemispherical coverage.

2. Description of the Prior Art

Prior to the availability of high power microwave sources many of the antennas designed for radar systems were of the array type that operated at VHF and UHF frequencies. With the advent of the magnetron, however, interest in the array antennas waned and antenna designers concentrated their efforts on reflector and lens type antennas. These antenna types were easier to design, simpler to manufacture, were reliable and performed adequately in the target environment of the radar systems for which they were designed. These environments generally included relatively slow moving targets, one of which could be selected for tracking by the radar system. Modern radar systems, however, have been required to track a plurality of rapidly moving airborne targets over a wide range of vertical and horizontal angles. For example, applications exist wherefore hemispherical coverage and tracking capability is required. These requirements dictate specifications upon the antenna design that for many of the modern radar applications cannot be met by the mechanically rotating reflector and lens type antennas. Thus interest has been refocussed on phase array antennas because of their flexibility and rapid beam positioning capabilities. An antenna with rapid beam positioning characteristics and capable of providing the aforementioned hemispherical coverage is disclosed in U.S. Pat. No. 3,755,815, issued to John J. Stangel et al. on Aug. 28, 1973 and assigned to the assignee of the present invention. Hemispherical coverage is provided by the Stangel et al antenna with the utilization of a single phase array enclosed within a refracting surface which includes a plurality of modules, each comprising an element for receiving signals emitted from the array, a discrete element phase shifter for imparting phase shift to the received signals, and a transmitting element for radiating the phase shifted signal. Discrete elements for providing the refracting surface become impractical at frequencies above 10 GHz where they are lossy, subject to severe tolerance requirements, and are relatively expensive.

The subject invention discloses a dome constructed of dielectric material for imparting the required refraction to signals incident from the phase array to provide hemispherical coverage. This dome is relatively inexpensive and is not subject to severe tolerance requirements at the higher frequencies.

SUMMARY OF THE INVENTION

A scanning antenna constructed in accordance with the principles of the present invention includes a spherical dome constructed of an inhomogeneous dielectric material. This dielectric material has an axis of symmetry that is substantially coincident with the radius of the spherical dome which is perpendicular to the equatorial plane thereof. The inhomogeneity of the dielectric material is such that the dielectric constant linearly decreases as the perpendicular distance from the equatorial plane increases. This variation of dielectric constant may be achieved with cylindrical slabs of uniform height, concentrically positioned along the axis of symmetry, the radius and dielectric constant of the slabs decreasing as the distance from the equatorial plane increases. A feed array may be centrally positioned in the equatorial plane, the electromagnetic signals from which may be continuously refracted as they propagate through the inhomogeneous dielectric material until they emerge from the surface of the sphere, after which they continue to propagate in free space along the straight path dictated by their angle of refraction at the surface of the sphere. Due to the refraction of the propagating waves within the inhomogeneous dielectric material, a beam may be directed in space at any desired angle from the zenith to below the horizon, the angular range below the horizon being dependent upon the dielectric constant of the inhomogeneous material in the equatorial plane, the gradient of dielectric constant through the sphere, and the dimensions of the feed array relative to the radius of the sphere.

DESCRIPTION OF THE PREFERRED EMBODIMENTS

Figure 1:
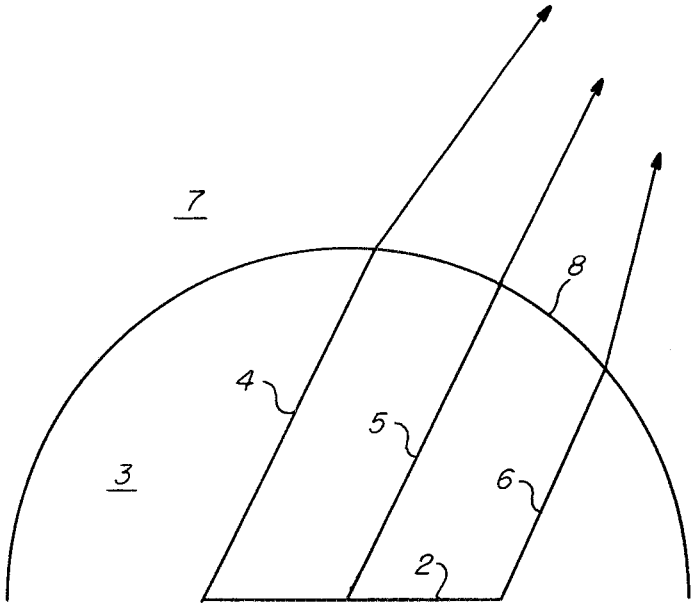
FIG. 1 is a schematic diagram of a hemispherical dome constructed of homogeneous dielectric material with the feed array positioned in the equatorial plane, useful for explaining the operation of the invention.

The radiation characteristics of a feed array, with dimensions large compared to the wavelength of the radiated signal, positioned in the base plane of a substantially solid dielectric dome may be analyzed with the utilization of geometrical object techniques. FIG. 1 schematically represents a feed array 2 positioned in the base plane of a solid dielectric dome, which in the figure is the equatorial plane of a hemispherical dome 3, constructed of a solid dielectric material having uniform dielectric constant. The rays emanating from the array 2 propagate through the media along straight line paths 4, 5 and 6 and are refracted into free space 7 at the surface 8 of the sphere 3 in accordance with Snell's Law. Since the radius of the sphere is normal to the surface 8 of the sphere 3, and the dielectric constant is uniform, a ray emanating from the sphere's center propagates along a radial path and will not be refracted when it emerges from the dome to enter the free space region. Thus a homogeneous dome with a feed array position in the equatorial plane does not provide scan angle amplification and the feed array dome combination is limited to the scan angle capabilities of the feed array alone. Scan angle amplification may be achieved, however, when the dome is spherical and the feed array is positioned in a base plane that is not the equatorial plane, when the dome is not spherical, or when the dome is spherical, the feed array is positioned in equatorial plane and the dome is constructed of a dielectric material having a dielectric constant which varies in a prescribed manner as a function of the distance from the equatorial plane. For the latter situation rays emanating from the feed array are refracted in the internal region of the sphere and are incident to the surface thereof with a scan angle amplification which may be further increased by the refraction of the rays into free space at the surface of the sphere.

Figure 2:
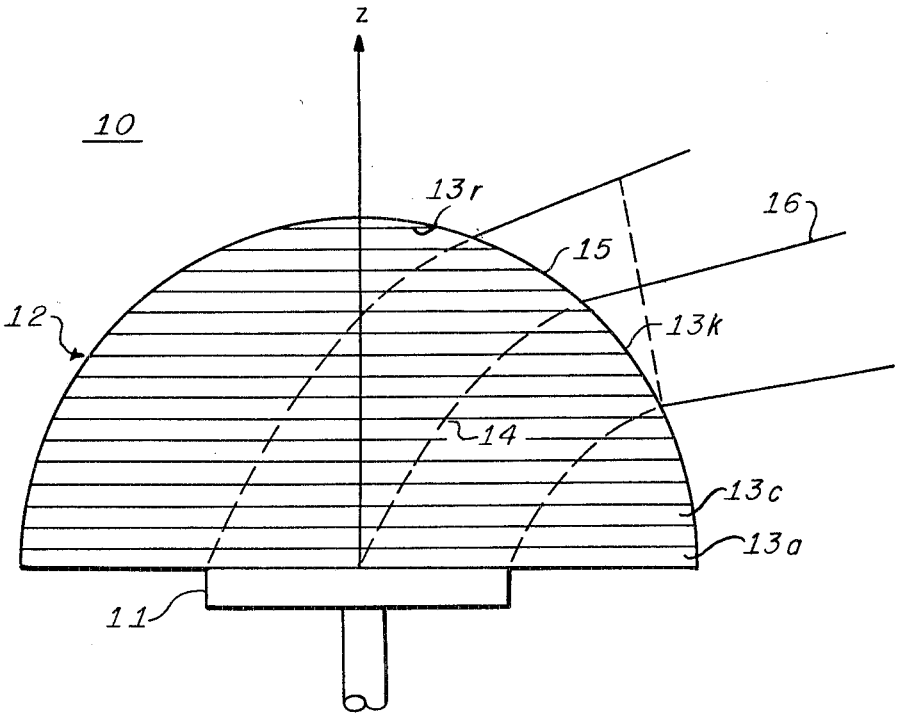
FIG. 2 is a diagram of a preferred embodiment of the invention showing, in cross-sectional view, a hemispherical dome constructed of an inhomogeneous dielectric material, a feed array positioned in the equatorial plane of the hemisphere, ray paths through the inhomogeneous dielectric material, and rays emerging from the hemispherical dome.

Referring to FIG. 2, a dome antenna 10 with hemispherical scan capabilities may comprise a feed array 11 centrally positioned in a base plane, that may be the equatorial plane of a hemispherical dome 12 with a radius R constructed of a multiplicity of substantially circular dielectric slabs 13*a* through 13*r* coaxially layered with decreasing radius to substantially form a spherical dome. Each of the slabs 13*a* through 13*r* are constructed of a dielectric material, the dielectric constant of which decreases as the distance of the substantially cylindrical dielectric slabs from the equatorial plane increases. These dielectric constants may be so chosen to provide a linearly decreasing dielectric constant as a function of the distance from the equatorial plane. If the radius perpendicular to the equatorial plane lies along the z-axis of the system, this variation may be represented by:

$$\epsilon(z) = 1 + K\left(1 - \frac{z}{R}\right)$$

where 1+K is the dielectric constant in the equatorial plane whereat z=0. A ray, as for example the central ray 14, emanating from the array 11 into the non-homogeneous dielectric dome 12 will be continuously refracted in the interior of the dome until it approaches the outer surface 15 of the sphere 12, whereat it is refracted once again as it enters the free space region and continues to propagate therein along a straight line path 16.

Figure 3:
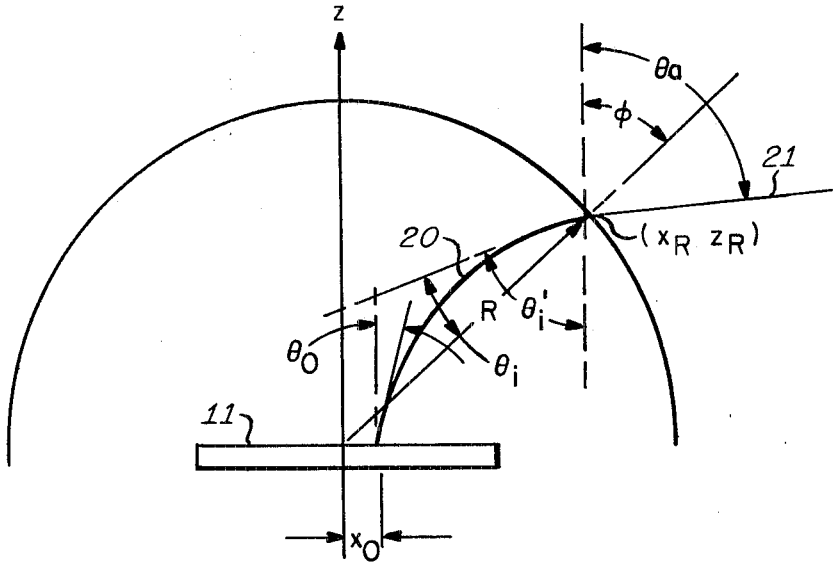
FIGS. 3 and 4 show ray traces through the inhomogeneous dielectric material of the hemispherical dome and rays emerging therefrom.

Refer now to FIG. 3 which shows the path of a ray emanating from the array at a distance $x_0$ from the center of the sphere at an angle $\theta_0$ with respect to the z-axis. When the dielectric constant of the dome material varies in accordance with $$\epsilon(z) = 1 + K\left(1 - \frac{z}{R}\right)$$

the refractive index of the dome n(z) will vary in accordance with $$n(z) = \sqrt{1 + K\left(1 - \frac{z}{R}\right)}\ .$$

At the boundary between two dielectrics, the angle of incidence to the boundary with respect to the normal at the point of incidence and the refracted angle with respect to the normal must satisfy Snell's Law $n_1 \sin\theta = n_2 \sin\theta_2$, which states that the components of the incident and refracted rays tangential to the boundary are equal. In systems containing multiple boundaries, Snell's Law requires that all tangential components of the rays be equal, thus for the non-homogeneous dielectric dome the horizontal components at any distance z from the equatorial plane must equal $$n(z)\sin\theta_z = \sqrt{1+K}\sin\theta_0 = \alpha$$

At the surface of the sphere, the interface between the dielectric material at the surface and free space, this relationship no longer holds, for the normal to the interface is now the radial line through the point of incidence on the sphere's surface and not the z-axis which is normal to all interfaces internal to the sphere. At the point of incidence on the surface of the sphere the refracted ray 21 forms an angle $\theta_a$ with respect to the translated z-axis, where $\theta_a$ is the desired scan angle. Additionally, the radial line passing through the point of incidence $(x_R, z_R)$ forms an angle of $\phi$ with respect to the translated z-axis and the ray path at the point of incidence $(x_R, z_R)$ forms an angle of $\theta_i'$ with the translated z-axis. Since at the point of incidence $(x_R, z_R)$ the radial line is normal to the interface of interest Snell's Law requires $n(z_R)\sin(\theta_i' - \phi) = \sin(\theta_a - \phi)$. Since $n(z_R)\sin\theta_i = \alpha$, $z_R = R\cos\phi$, and $x_R = R\sin\phi$, $$\alpha z_R - x_R\sqrt{n^2(z_R) - \alpha^2} = z_R \sin\theta_a - x_R\cos\theta_a. \quad (1)$$

Those skilled in the art will recognize that the ray path is defined by $$x_R\ \alpha \int_O^{z_R} \frac{dz}{\sqrt{n^2(z) - \alpha^2}} + x_O \quad (2)$$

Equations (1) and (2) may be utilized to determine the point $(x_R, z_R)$ with which the electrical length l of the ray path may be determined from $$l = \alpha(x_R - x_O) + \int_O^{z_R} \sqrt{n^2(z) - \alpha^2}\, dz \quad (3)$$

If the free space wave number of the signal radiated from the feed array is k, then the phase delay of the ray from the point $(x_0 O)$ to the point $(x_R, z_R)$ is kl.

Equations (1), (2) and (3) may be utilized to determine the ray paths and phase delays from which each element in the feed array to the surface of the sphere for a desired free space scan angle $\theta_a$ and a chosen feed array scan angle $\theta_0$.

Figure 4:
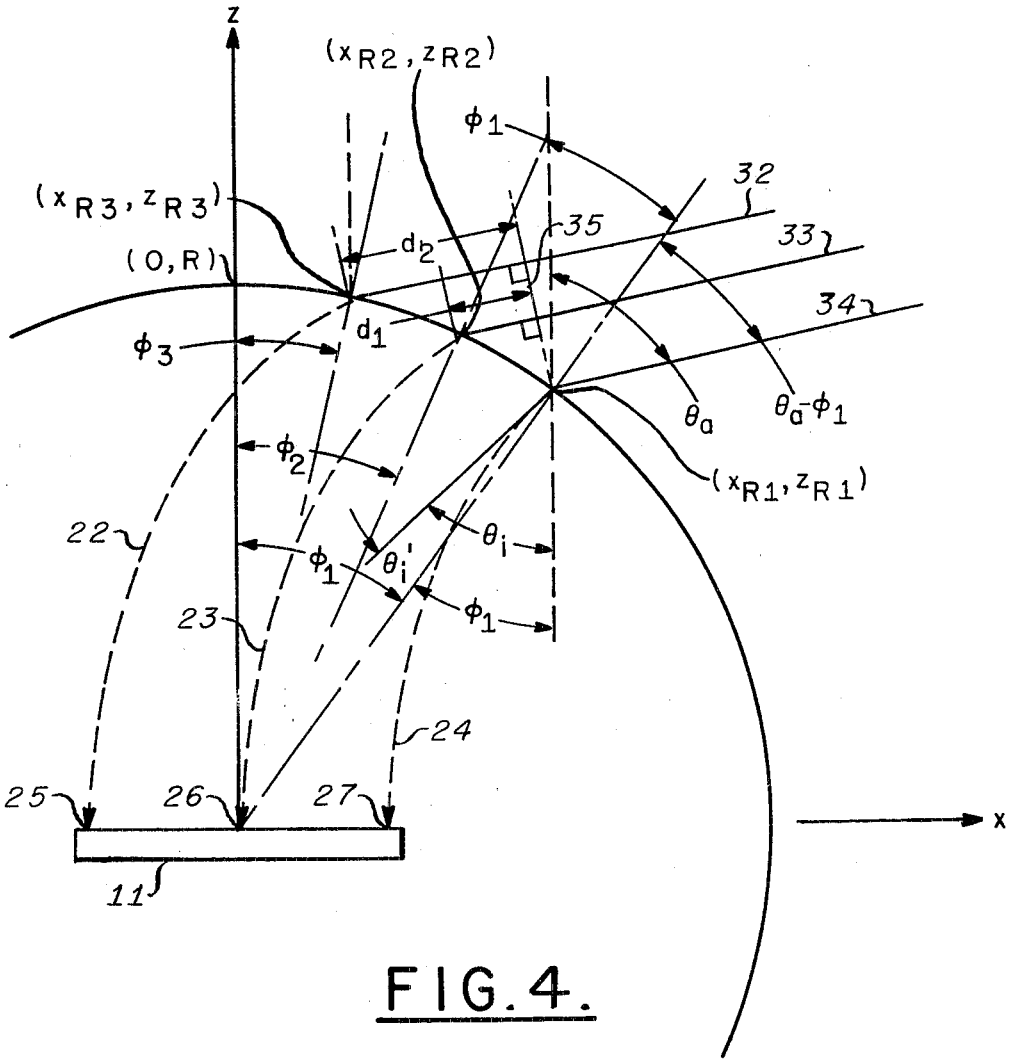

To radiate a beam in space at the desired scan angle $\theta_a$, the electrical path length from each element in the feed array through the sphere and from the sphere to a plane perpendicular to the free space ray paths must be equal. As stated above, the electrical length, determined by Equation (3), when multiplied by the free space wave number k, provides the phase delay between each element in the feed array and the surface of the sphere. The phase delay for each internal ray path plus the corresponding free space ray path from the surface of the sphere to the perpendicular plane must be equal for all ray paths from the feed array 11 to form a beam in the desired $\theta_a$ direction. In FIG. 4 ray paths 22, 23 and 24, are respectively drawn from the left extreme element 25, the central element 26, and the right extreme element 27 of the feed array 11. These ray paths are incident to the surface of the sphere at the points $(x_{R3},z_{R3})$, $(x_{R2},z_{R2})$, and $(x_{R1},z_{R1})$ respectively. From these three points the signal continues to propagate in free space along the paths 32, 33 and 34, respectively, with the paths being of substantially equal length to distant points in space from the perpendicular to these paths that passes through the point $(x_{R1},z_{R1})$. In order for the beam to be properly formed in the direction $\theta_a$, the signals arriving at the point defined by their respective paths and the perpendicular 35 to these paths must all be in phase. This may be accomplished by determining the phase differential along the free space propagation paths 32,33, and 34 to the perpendicular 35 to these paths. As for example, the differential path lengths $d_1$ and $d_2$ with respect to the point $(x_{R1},z_{R1})$, and adding the phase delay resulting from such differential line lengths to the internal phase delays previously determined. In this manner, the phase differences at the perpendicular 35 may be ascertained and compensation therefor may be included in the phase shifting network of the scannable feed array 11. The differential path lengths $d_1$ and $d_2$ may be determined from $$d_1=(x_{R1}-x_{R2})\sin\theta_a-(z_{R2}-z_{R1})\cos\theta_a$$

$$d_2=(x_{R1}-x_{R3})\sin\theta_a-(z_{R3}-z_{R1})\cos\theta_a$$

Thus the phase difference along the combined paths 22–32 and 23–33 at the perpendicular 35 relative to the phase at the point $(x_{R1},z_R)$ is given by $$\psi_{10}=k(l_1-l_0+d_1)$$

$$\psi_{20}=k(l_2-l_0+d_2)$$

where $l_0$, $l_1$ and $l_2$ are the internal path lengths of rays 24, 23, and 22, respectively.

Of interest in any antenna design is the area in the plane perpendicular to all parallel rays, for a given free space scan angle, enclosing all such rays. This area designated the projected area is a major factor in the determination of the antenna gain in the scan direction. The projected area for a given scan angle may be determined for any feed array configuration by tracing the ray paths through the inhomogeneous dielectric sphere into free space from a multiplicity of edge elements of the feed array in the planes that include the z-axis and the element of interest, in the manner described above, passing a plane perpendicular to the free space ray paths, establishing the perimeter of the projected aperture in this plane by drawing a continuous line sequentially through each of the points of intersection of the free space rays with the perpendicular plane, and determining the area enclosed by this perimeter.

Figure 5:
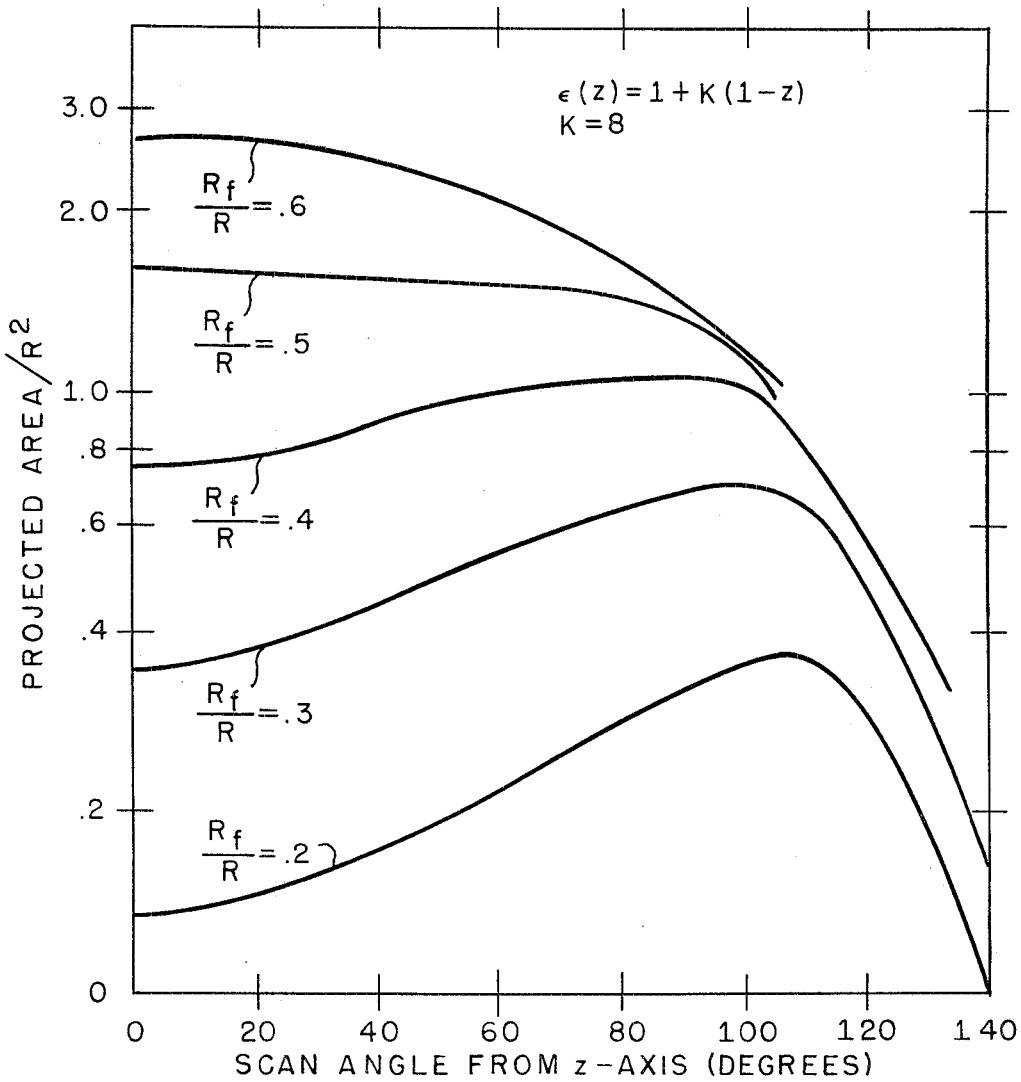
FIGS. 5 and 6 are graphs of the projected aperture at the surface of the hemispherical dome versus scan angle for various feed array radii and two linear dielectric constant variations for the dielectric material of the hemispherical dome.
Figure 6:
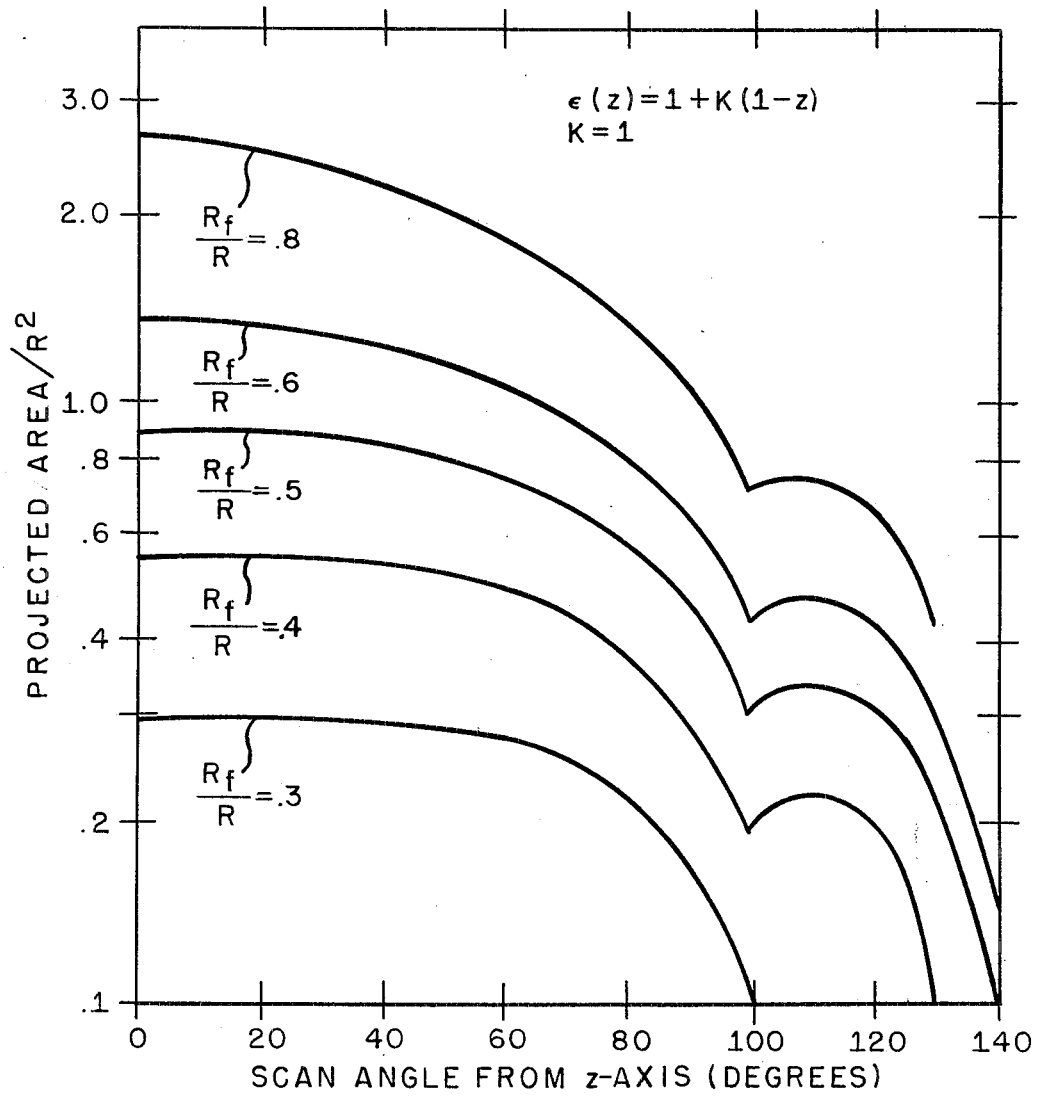

FIGS. 5 and 6 are plots of a projected area normalized to the square of the radius of the spherical dome for K=8 and K=1 respectively and for various radii of the feed array normalized to the radius of the spherical dome which were calculated in this manner. It is readily ascertained from these figures that considerable projected aperture is available for scan angles to the horizon and below. Though the analysis leading to the curves in FIGS. 5 and 6 has been for linear variation of dielectric constant with perpendicular distance from the feed array, it will be apparent to those skilled in the art that similar results may be obtained with dielectric variations other than linear, as previously mentioned, the scan angle amplification may be achieved with dielectric domes having contours other than spherical.

While the invention has been described in its preferred embodiments, it is to be understood that the words which have been used are words of description rather than of limitation and that changes within the purview of the appended claims may be made without departing from the true scope and spirit of the invention in its broader aspects.

What is claimed is:

1. A scanning antenna including a dome shaped substantially as a hemisphere having an external surface at a radius R, a base plane substantially coincident with said hemisphere's equatorial plane, a z-axis perpendicular to said base plane with z values increasing therefrom, and a dielectric material with a dielectric constant $\epsilon(z)$ that decreases linearly as said Z-values increase in accordance with $\epsilon(z)=1=+K(1-z/R)$, K being a constant, filing substantially all space between said base plane and said external surface, constructed and arranged such that a ray of an electromagnetic signal incident to said base plane at a first angle with respect to said z-axis is plurally refracted between said base plane and said external surface to emerge from said external surface at a second angle with respect to said z-axis which is at least as great as said first angle, thus providing an angle amplification, said angle amplification varying as a function of said first angle, being unity for a ray perpendicularly incident to said base plane and increasing with increasing first angle.

2. A scanning antenna in accordance with claim 1 wherein said dome comprises a plurality of substantially circular cylinders of dielectric material, each of said cylinders having a radius that differs from the radius of other cylinders of said plurality of substantially circular cylinders and a dielectric constant that differs from the dielectric constant of other cylinders of said plurality of substantially circular cylinders, said plurality of substantially circular cylinders substantially concentrically layered to establish said dome shaped substantially as a hemisphere with said equatorial plane as a base plane and having said linearly decreasing dielectric constant $\epsilon(z)$.

3. A scanning antenna in accordance with claims 1, or 2 further including feed array means positioned in said base plane for emitting said electromagnetic signals at said first angle with respect to said z-axis.

* * * * *